United States Patent [19]

Handley

[11] Patent Number: 4,489,677

[45] Date of Patent: Dec. 25, 1984

[54] ANIMAL SUPPORT SLING

[75] Inventor: John E. Handley, Matamata, New Zealand

[73] Assignee: Matamata Motor Trimmers Limited, Matamata, New Zealand

[21] Appl. No.: 457,588

[22] Filed: Jan. 13, 1983

[51] Int. Cl.[3] ..... A61D 3/00

[52] U.S. Cl. ..... 119/102

[58] Field of Search ..... 119/102, 96, 100, 98

[56] References Cited

U.S. PATENT DOCUMENTS

| | | | |
|---|---|---|---|
| 163,378 | 5/1875 | Johnson | 119/102 |
| D. 201,010 | 5/1965 | Koon et al. | 119/102 |
| 1,015,239 | 1/1912 | Miller | 119/102 |
| 1,277,052 | 8/1918 | Dunn | 119/102 |

FOREIGN PATENT DOCUMENTS

| | | | |
|---|---|---|---|
| 157374 | 3/1954 | Australia | 119/102 |

*Primary Examiner*—Gene Mancene

*Assistant Examiner*—Kris R. Schulze

[57] ABSTRACT

An animal support apparatus in the form of a stretcher which upon being placed beneath an animal can be supported and raised by a lifting means. The apparatus comprises a frame having suspended therefrom a pair of elongate laterally spaced apart members which support a sling therebetween. Flaps are provided at both ends of the sling the flaps being supported by straps which extend up to the corresponding ends of the elongate members. In use the straps fit between the legs of an animal such that with raising of the support the animal's legs depend downwardly of the sling. A cut-out can be provided adjacent one end of the sling to similarly accommodate an udder of an animal.

6 Claims, 1 Drawing Figure

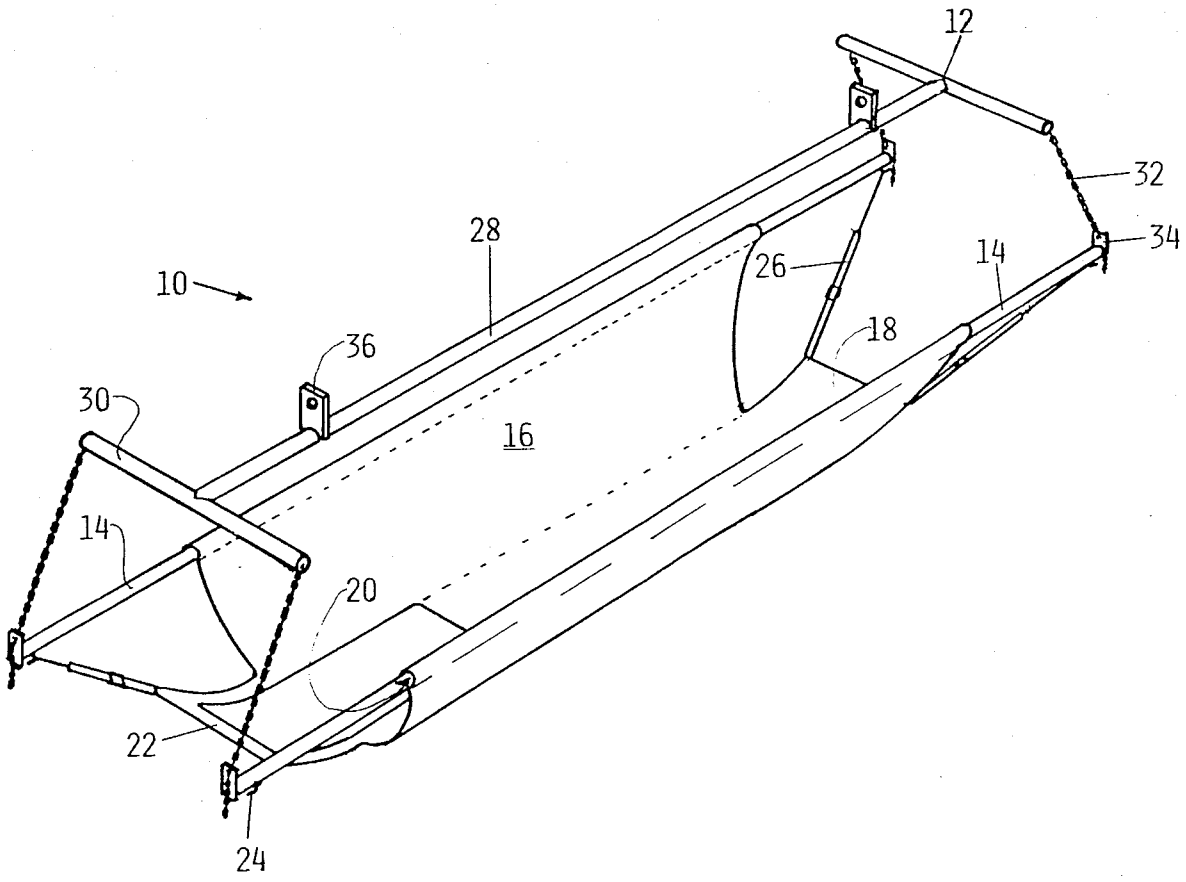
10
12
14
14
16
18
20
22
24
26
28
30
32
34
36

ANIMAL SUPPORT SLING

BACKGROUND OF THE INVENTION

This invention relates to an animal support apparatus, and has particular application to apparatus for supporting a cow in a standing position.

When stock are sick or immobilised, it is desirable to maintain them on their feet. It is also desirable to hold stock in an upright position, in a restrained fashion, for treatment. Previous methods of lifting or suspending stock, for example a hip fitting type of harness lifter for use on cows, have not proved to be satisfactory. Clamping against the animal's hip is at least considered to be unpleasant and uncomfortable for the animal and can cause damage to the animal.

BRIEF SUMMARY OF THE INVENTION

It is an object of this invention to provide an improved animal support apparatus. According to a broad aspect of the invention there is provided an animal support apparatus comprising a frame adapted for engagement with a lifting means, for example a hoist of a tractor and including a pair of laterally spaced apart longitudinal members suspended from said frame, the longitudinal members supporting a sling therebetween provided with cut-outs to accommodate the extremities, in particular the limbs of an animal supported by the sling.

BRIEF DESCRIPTION OF THE DRAWING

In further describing this invention reference is made to a preferred embodiment with reference to the accompanying drawing which is a partly schematic perspective view of a preferred animal support apparatus.

DETAILED DESCRIPTION

The animal support apparatus 10 incorporates a support frame 12, a pair of substantially rigid members 14 suspended from the frame 12, the members 14 supporting a sling 16 therebetween. The sling 16 is substantially rectangular in shape having extending from one end thereof a flap 18. In use the flap 18 substantially covers and supports the chest of an animal located in the sling 16. The sling 16, preferably formed from a flexible material for example canvas or P.V.C., is suspended between said pair of members 14 and incorporates two open ended sheaths 20 to accommodate a corresponding member 14 therein, such that the end of the members 14 protrude therefrom. The sheaths 20 are conveniently formed by folding back and then securing in position the two sides of the sling. Reinforcing, such as leather or material strips, is preferably provided along seams and cut edges of the sling 16. The seams and reinforcing are preferably secured by stitching, however it will be appreciated that rivets or alternative fasteners can be used. A further flap 22 extends from the other end of the sling 16, and is adapted, by means of a cut-out segment, to accommodate therethrough portions of an animal suspended in the sling 16, for example the udder of a cow.

The members 14 are formed from lengths of extruded tubular metal expediently plates or otherwise treated to be corrosive resistant and incorporate adjacent each end thereof, hooks 24. However, it will be appreciated that alternative materials can be used when forming the support members 14.

A pair of flexible straps 26 provided to, in use, locate and support an animal in the sling 16, are attached to the outer end of each of the flaps 18 and 22. The straps 26 are preferably formed from a material able to withstand the load of a support animal, for example, leather or synthetic webbed material. The straps 26 are adjustable in length and engageable with the hooks 24 on the members 14. The support apparatus 10 is shaped such that the legs of an animal can fit through the apertures defined by the sling 16, flaps 18 and 22, the straps 26 and the members 14. In this way, the weight of an animal can be taken adjacent the inside of the top, of the front and rear legs.

It is preferred that the sling 16 is suspended from a support frame 12. The support frame 12 is provided with a main longitudinal member 28 of a length commensurate with the length of the sling, and is provided with cross pieces 30 at each end thereof. The support frame 12 is preferably formed from lengths of extruded tubular metal expediently plated or otherwise treated to be corrosive resistant. However, it will be appreciated that a frame of alternative materials can configuration can be used.

Suspension members 32 bridge between the support frame 12 and the members 14, thus the members 32 have a first end disposed at, and engaging, each end of the cross pieces 30 and the second end disposed at, and engaging, each end of the members 14. It is preferred that the suspension members 32 are in the form of chains, which are adjustably engaged by hooks 34, or alternative engaging means, to either the cross pieces 30 or to the members 14, or both.

The support frame 12 is provided with attachment points, for example, a pair of lugs 36 disposed on the longitudinal member 28. The lugs 36 are adapted for attachment to a front-end loader, however it will be appreciated that alternative lifting means can be used.

In use, the members 14, for convenience, may be removed from the sheaths 20 of the sling 16 facilitating easier positioning of the sling 16 under a lying animal, for example a cow. The straps 26 are passed in a longitudinal direction, between the front and rear legs of the cow and then connected to the members 14. At this stage, the udder of the cow should be positioned through the cut-out flap 22, and flap 18 should be positioned to provide support to the chest of the cow. The members 14 can then be attached to the support frame 12, by way of the suspension members 32. For convenience the support frame 12 may be already connected to a lifting means, for example the front-end loader of a tractor. By connecting the suspension members 32 to the respective ends of the members 14 and the cross braces 30, the sling 16 can be adjusted to a substantially horizontal position; and the cow raised from the ground into a standing position. The cow can be supported in this fashion for some time without undue discomfort. By providing adjustable straps 26 and suspension members 32 it is possible to adjust the support apparatus 10 to suit each individual animal.

Finally, it will be appreciated that various alterations or modifications may be made to the foregoing without departing from the scope of this invention.

We claim:

1. An animal support apparatus comprising an elongated support frame adapted for engagement with a lifting means and having an elongated cross member at each end thereof, suspension elements depending from each end of the cross members, a pair of laterally spaced apart elongate members supported by said suspension members, a sling with lateral edges, means for mounting said sling along its lateral edges to the elongate members as to be supported therebetween, the elongate members extending longitudinally well clear of the means for mounting said sling and the sling incorporating end flaps disposed centrally of each end thereof a first end of each flap secured to an associated end of the sling and each flap having an opposite end, straps which are secured to the opposite ends of each flap and are removably attachable to an associated end of said elongate members, the end flaps being supported in a longitudinally extended position by said straps when attached to the associated ends of the elongate members, thereby defining leg accommodating apertures, in use the sling fitting beneath an underside of an animal with each leg of the animal extending through the associated leg accommodating aperture such that with raising of the support the weight of the animal is taken adjacent the inside of the top of each of its legs.

2. An animal support apparatus as claimed in claim 1 wherein a cut-out is formed at one end of the sling, the cut-out substantially extending into the flap as will in use accommodate an udder of an animal.

3. An animal support apparatus as claimed in claim 1, wherein said end flaps are of a rectangular construction, two corners of each of the rectangular flaps being joined to said sling and the other two corners of each rectangular flap being joined to separate ones of said straps.

4. An animal support apparatus according to claim 3, wherein one of said flaps and said sling include a generally rectangular shaped cutout which, in use, accommodates the utter of an animal.

5. An animal support apparatus comprising:

(a) an elongated support frame having two ends;

(b) a pair of cross members each having two ends, each cross member being disposed at one end of said support frame;

(c) a pair of generally parallel, spaced apart elongate members each of which is supported from one end of each of said cross members;

(d) a flexible sling having at least two sides;

(e) means for supporting the sides of said sling from said elongate members, said elongate members extending longitudinally well clear of the sides of said sling;

(f) said sling having end flaps disposed between said elongate members, a first end of each flap secured to an associated end of the sling and each flap having an opposite end;

(g) means for supporting said flaps at the opposite ends thereof in a generally longitudinally extended position from said sling, whereby said flaps, in use, define leg accommodating apertures for supporting an animal adjacent the inside of the top of each of its legs, said supporting means being coupled to and supported by the ends of said elongate members.

6. The animal support of claim 5 wherein said supporting means are provided by straps which are coupled to said flaps and to said elongate members.

* * * * *